US005615642A

United States Patent [19]

Coughlin

[11] Patent Number: 5,615,642

[45] Date of Patent: Apr. 1, 1997

[54] MOTORCYCLE ENGINE

[75] Inventor: Jeffrey P. Coughlin, Germantown, Wis.

[73] Assignee: Harley-Davidson Motor Company, Milwaukee, Wis.

[21] Appl. No.: 595,414

[22] Filed: Feb. 5, 1996

[51] Int. Cl.[6] ..... F02B 75/32

[52] U.S. Cl. ..... 123/54.4; 123/55.1; 123/197.3; 184/6.6; 184/6.19

[58] Field of Search ..... 123/197.4, 197.3, 123/54.4, 54.6, 55.1; 184/6.5, 6.6, 6.19

[56] References Cited

U.S. PATENT DOCUMENTS

| | | | |
|---|---|---|---|
| 1,039,492 | 9/1912 | Courtwright et al. . | |
| 1,498,757 | 6/1924 | Robertson | 123/54.7 |
| 1,814,333 | 7/1931 | Parker . | |
| 1,873,908 | 8/1932 | Schlinke . | |
| 2,169,120 | 8/1939 | Busby . | |
| 2,202,761 | 5/1940 | Fiedler | 123/69 |
| 2,252,051 | 8/1941 | Towle | 184/6.6 |
| 2,287,735 | 6/1946 | Halford | 184/6.6 |
| 3,523,592 | 8/1970 | Fenton | 184/6.6 |
| 5,072,654 | 12/1991 | MacGregor | 123/197.3 |

OTHER PUBLICATIONS

The Cooper–Bessemer Corporation, "Engine Illustrations", p. 451.

1993 & 1994 Harley & Davidson Service Manual–XLH Models, pp. 3–41, 3–42, 3–43, 3–44, 3–45 and Figure 3–43, Lubrication Diagram.

*Primary Examiner*—Erick R. Solis

*Attorney, Agent, or Firm*—Michael, Best & Friedrich

[57] ABSTRACT

A motorcycle engine having a pair of cylinders, a piston disposed in each-cylinder, rotatably mounted flywheels, a crank pin mounted on the flywheels, and a connecting rod assembly for coupling the crank pin to the pistons. The connecting rod assembly includes a master connecting rod having a connecting rod portion connected at one end to one of the pistons and a base portion at its other end. A cap is removably mounted on the base portion and defines with the base portion a coupling for receiving the crank pin. A split bushing is disposed between the coupling and the crank pin. The connecting rod assembly also includes a slave connecting rod connected at one end to the other piston. An aperture is formed in the base portion, a second bushing is disposed in the aperture and a pin is disposed in the second bushing. The other end of the slave connecting rod is pivotally mounted on the pin. Oil ports are formed in the split bushing, the base portion and the second bushing for defining an oil passage between the pin and the crank pin.

12 Claims, 2 Drawing Sheets

MOTORCYCLE ENGINE

BACKGROUND OF THE INVENTION

This invention relates to motorcycle engines and, more particularly, to a connecting rod assembly for motorcycle engines.

Prior art motorcycle engines, such as the Harley-Davidson 1340 cc Evolution engine require that the crank shaft be built up in order to assemble the connecting rods. Also, due to the space requirements, roller element bearings are required. As a result, there is a need for a motorcycle engine design which simplifies manufacture and assembly.

SUMMARY OF THE INVENTION

It is an object of the invention to provide a new and improved motorcycle engine.

A further object of the invention is to provide a new and improved connecting rod assembly for motorcycle engines.

Another object of the invention is to provide a connecting rod assembly for motorcycle engines which simplifies assembly.

A still further object of the invention is to provide a new and improved oil circulation system for the connecting rods of motorcycle engines.

Yet another object of the invention is to provide an improved connecting rod assembly for use with an engine having a pair of in-line cylinders.

In general terms, the invention comprises a motorcycle engine having a pair of cylinders (positioned in the same plane), a piston disposed in each cylinder, rotatably mounted flywheel means coupled to the pistons, a crank pin mounted on the flywheel means, and a connecting rod assembly for coupling the crank pin to the pistons. The connecting rod assembly includes a master rod having a connecting rod portion connected at one end to one of the pistons and a base portion at its other end, a cap removably mounted on the base portion and defining with the base portion a coupling for receiving the crank pin, and a split bushing disposed between the coupling and the crank pin. An aperture is formed in the base portion, a second bushing is disposed in the aperture, a second pin is disposed in the second bushing and a slave connecting rod is connected at one end to the other piston. The other end of the slave connecting rod is pivotally mounted on the second pin, and oil ports are formed in each of the split bushing, the base portion and the bushing for defining an oil passage between the second pin and the crank pin.

DETAILED DESCRIPTION OF THE PREFERRED EMBODIMENT

Figure 1:
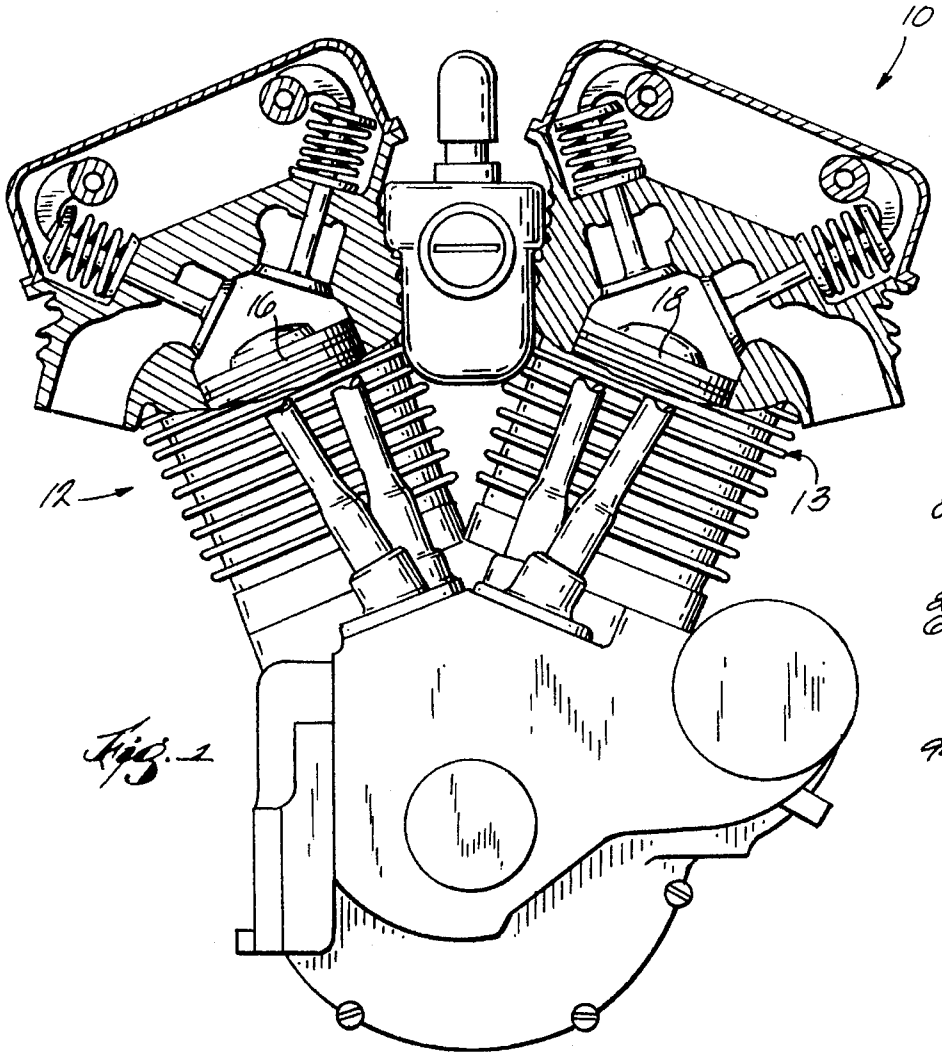
FIG. 1 shows a motorcycle engine, with parts broken away, in which the preferred embodiment of the invention, may be incorporated.

FIG. 1 illustrates a motorcycle engine 10 such as, for example, a Harley-Davidson 1340 cc Evolution engine. While the invention is described in connection with this Harley-Davidson engine, those skilled in the art will appreciate that the invention has application to other engines as well.

The illustrated engine 10 includes a pair of cylinders 12 and 13 which are arranged at an angle of about 45° and with corresponding portions positioned in the same plane. Pistons 16 and 18 are disposed in cylinders 12 and 13, respectively, for reciprocation therein through their intake, compression, ignition and exhaust cycles. The pistons 16 and 18 are coupled by a connecting rod assembly 19 (FIG. 2) to a pair of flywheels 20 and 22 by a crank pin 50 and a split bushing 66. The flywheel 20 is rotatably mounted by means of a pinion shaft 28 which couples the flywheels to the motorcycle's transmission and flywheel 22 is rotatably mounted by means of a second shaft 30 which also couples the fly wheels to the cylinder valves.

The connecting rod assembly 19 includes a master rod 32 and a slave rod 34. The master rod 32 comprises a base portion 36 and a connecting rod portion 38 extending upwardly from the base portion. An eyelet 40 is formed at the upper end of the connecting rod portion 38 for connection to the piston 16 by a piston pin 41. A rod cap 42 is secured by bolts 44 to the base portion 36 of master connecting rod 32 and defines with the base portion 36 a generally cylindrical opening 48 for receiving the crank pin 50 and the bearings 52. The opposite ends of crank pin 50 are received in openings 56 and 58 in flywheels 20 and 22, respectively, for coupling the connecting rod assembly 19 to the flywheels.

A yoke 68 is provided on the lower end of slave rod 34 and includes a pair of coaxial eyelets 70 which are separated a distance equal to the thickness of the base portion 36 of the master connecting rod 32. An opening 74 is formed in the base portion 36 for alignment with the openings 75 in eyelets 70 for receiving a slave rod bushing 76 and slave rod pin 78. A pair of snap rings 80 may be used to retain the pin 78 in the openings 74 and 75. An eyelet 82 formed at the upper end of slave rod 34 is connected to piston 18 by a piston pin 84.

Figure 3:
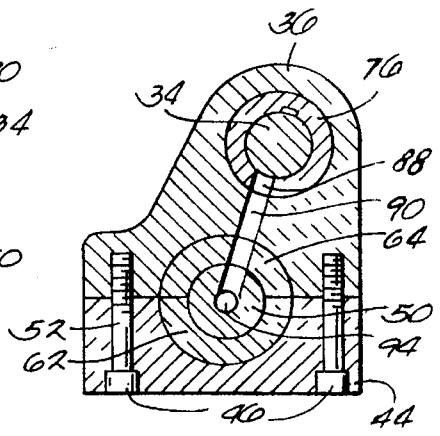
FIG. 3 is a cross-sectional view through a portion of the engine illustrated in FIGS. 1 and 2.
Figure 4:
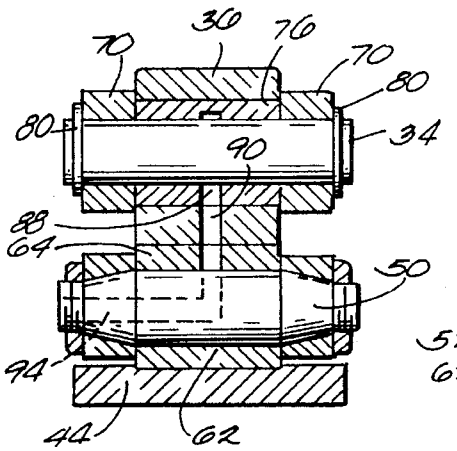
FIG. 4 is a view taken along lines 4—4 of FIG. 2.
Figure 2:
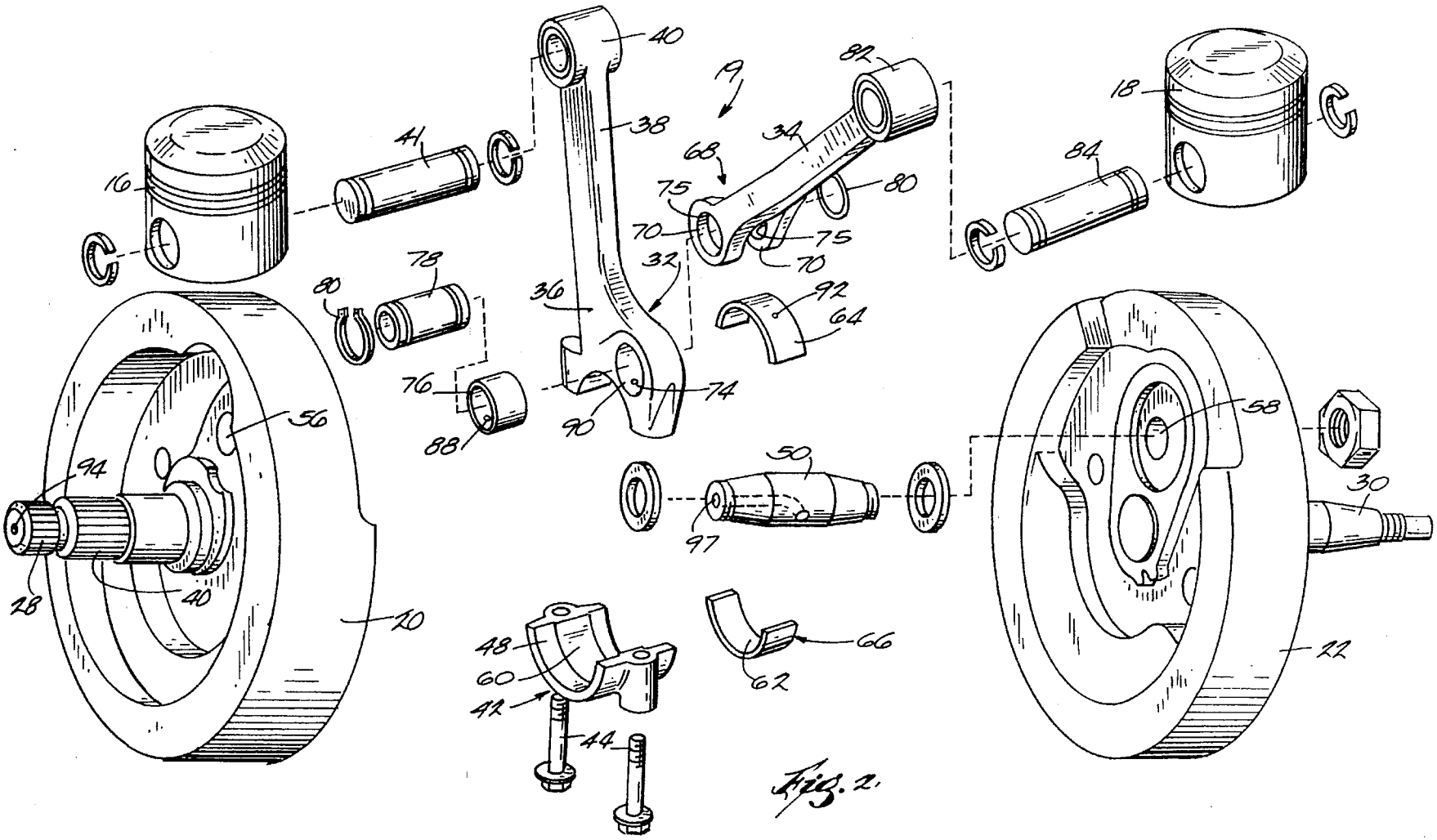
FIG. 2 is an exploded perspective view illustrating the connecting rod assembly according to the invention.

As seen in FIGS. 2, 3 and 4, the slave rod bushing 76, the base portion 36 of master rod 32, and the half 64 of split bushing 66 have aligned oil ports 88, 90 and 92, respectively. In addition, there is a passage 94 formed on the pinion shaft 28 which communicates with a passage (not shown) in flywheel 20 where it is routed to a passage 97 in the crank pin 50.

As those skilled in the art will appreciate, motorcycle engines, such as the Harley-Davidson 1340 cc Evolution engine, includes an oil pump (not shown) which delivers oil under pressure through an oil filter and a check valve to passages in the crank case where it flows to various parts of the engine including the passage 97 in crank pin 50 through passage 94 in pinion shaft 28, the passage in flywheel 20. From the crank pin 50, the lubricating oil flows through passages 92, 90 and 88 for lubricating the crank pin 50, the master rod bushing 66, the slave rod bushing 76 and the slave rod pin 34.

Prior motorcycle engines require that the crank shaft be built up in order to assemble the connecting rods. Also, due to space requirements, roller element bearings are required. By splitting the master connecting rod, a one-piece crank shaft can be utilized. This also allows the use of standard split shell bearings.

While only a single embodiment of the invention has been illustrated and described, it is not intended to be limited thereby, but only by the scope of the appended claims.

I claim:

1. A motorcycle engine having at least a pair of cylinders, a piston disposed in each said cylinder, cranking means for translating reciprocal movement of said pistons into rotary motion, and a connecting rod assembly for coupling said cranking means to said pistons, said connecting rod assembly including a master connecting rod connected to one of said pistons, a slave connecting rod connected to the other of said pistons, and pivot means for pivotally connecting said slave connecting rod to said master connecting rod, said cranking means and said master connecting rod each including an oil passage adapted to provide oil to said pivot means.

2. The motorcycle engine set forth in claim 1 wherein said pivot means comprises an aperture formed in said master connecting rod, a bushing disposed in said aperture, and a pin disposed in said bushing, said slave connecting rod being pivotally mounted to said pin, and said bushing including an oil port in communication with said oil passage in said master connecting rod.

3. The motorcycle engine set forth in claim 1 wherein said cranking means comprises at least one rotatably mounted flywheel and a crank pin mounted on said flywheel, said master connecting rod being pivotally connected to said crank pin.

4. The motorcycle engine set forth in claim 1 and including a split bushing disposed between said cranking means and said master connecting rod, and an oil port formed in said split bushing and communicating with said oil passages.

5. The motorcycle engine set forth in claim 4 wherein said pivot means comprises an aperture formed in said master connecting rod, a bushing disposed in said aperture, and a pin disposed in said bushing, said slave connecting rod being pivotally mounted to said pin, and an oil port formed in said bushing, said oil port being in communication with said oil passage in said cranking means.

6. The motorcycle engine set forth in claim 5 wherein said cranking means comprises at least one rotatably mounted flywheel and a crank pin mounted on said flywheel, said master connecting rod being pivotally connected to said crank pin.

7. The motorcycle engine set forth in claim 6 wherein corresponding portions of said cylinders lie in the same plane.

8. An engine comprising:

a pair of cylinders;

a piston disposed in each said cylinder;

a pinion shaft;

a crank member mounted for rotation about said pinion shaft; and a connecting rod assembly for coupling said crank member to said pistons, said connecting rod assembly including:

a master connecting rod interconnecting one of said pistons with said crank member; and a slave connecting rod interconnecting the other of said pistons with said master connecting rod, said slave connecting rod being connected to said master connecting rod at a pivoting connection, wherein said master connecting rod includes a passage in communication with said pivoting connection to provide lubricating fluid to said pivoting connection.

9. An engine as claimed in claim 8, wherein said passage in said master connecting rod is in communication with a passage in said crank member.

10. An engine as claimed in claim 9, wherein said passage in said master connecting rod is in communication with said passage in said crank member at least once per revolution of said crank member.

11. An engine as claimed in claim 9, wherein said passage in said crank member is in communication with a passage in said pinion shaft.

12. An engine as claimed in claim 8, wherein said slave connecting rod includes a yoke for engaging said pivoting connection on opposing sides of said master connecting rod.

* * * * *